US005921326A

United States Patent [19]

Ragule

[11] Patent Number: 5,921,326

[45] Date of Patent: Jul. 13, 1999

[54] PLOW WITH FOLDING AUXILIARY BLADE

[76] Inventor: Edward J. Ragule, 82 Rock Hill Rd., Voorheesville, N.Y. 12186

[21] Appl. No.: 09/174,780

[22] Filed: Oct. 19, 1998

[51] Int. Cl.[6] ..... E01H 5/06

[52] U.S. Cl. ..... 172/815; 37/280

[58] Field of Search ..... 37/281, 283, 280, 37/279, 104, 105, 241; 172/815, 811, 810, 784, 777, 113

[56] References Cited

U.S. PATENT DOCUMENTS

| | | | |
|---|---|---|---|
| 3,216,337 | 11/1965 | MacDonald | 37/280 |
| 3,422,552 | 1/1969 | Gabel | 37/280 |
| 3,477,151 | 11/1969 | Zanella | 37/280 |
| 3,479,755 | 11/1969 | Schropp | 172/784 |
| 3,680,451 | 8/1972 | Birtchet | 404/104 |
| 4,077,139 | 3/1978 | Fagervold et al. | 172/784 |
| 4,099,578 | 7/1978 | Stevens | 172/815 |
| 4,369,847 | 1/1983 | Mizunuma | 172/815 |
| 4,479,312 | 10/1984 | Turgeon | 37/281 |
| 4,614,048 | 9/1986 | Melby | 37/280 |
| 4,723,609 | 2/1988 | Curtis | 172/815 |
| 4,779,363 | 10/1988 | Boutrais et al. | 172/815 |
| 5,758,728 | 6/1998 | Raglile | 172/815 |
| 5,848,654 | 12/1998 | Belcher, Jr. | 172/815 |

OTHER PUBLICATIONS

Root(TM) SnowPlows Adver.; Public Works Mag.; Jul. '98 ISS.

*Primary Examiner*—Thomas B. Will
*Assistant Examiner*—Kristine M Markovich
*Attorney, Agent, or Firm*—Fredric T. Morelle

[57] ABSTRACT

Plow windrow interruption by use of a folding auxiliary blade that is designed to overlay a portion of the plow main blade. The auxiliary blade is motivated to fold vertically pleatwise and, by alternating projection of the folded auxiliary forward of the trailing edge of the main blade, and a return to the overlying posture, respectively stop and reestablish the debris windrow.

10 Claims, 5 Drawing Sheets

PLOW WITH FOLDING AUXILIARY BLADE

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to mechanisms that are used to break or intermittently interrupt the flow of overburden that is cast off the end of a plow blade. Specifically, the instant plow invention, consisting of a plow blade adapted with an adjunctive, folding foreblade and supporting electrical and/or hydraulic blade drive systems, is an articulated blade apparatus.

2. Description of Related Art

Removal of debris, particularly snow, from paved roadways is done most often by plow. A snow removal problem that has received much attention in the past two or three decades is the creation of roadway and driveway blockage by the overburden pouring off the trailing edge of the plow blade. There have been numerous attempts to solve the problem by use of devices that intermittently impede formation of the continuous windrow that is normally formed by the trailing overburden. These devices consist mostly of an apparatus attached to the trailing edge of the plow blade, the function of which is to project a plate or smaller blade forward of the plow blade at an angle to it of from about 65 to about 80 degrees. The manner by which the plate or smaller blade is intruded into the debris flow exemplifies the greater quantity of creativity in this part of the art, because little is done in the way of altering the plow blade itself. Most of the plates are either translated from aft of the blade into the forward, acute angular relationship that is required to block the flow, or they (the blocking plates) are rotated downward and forward of the plow blade into that operating relationship. An example of the latter is produced by the ROOT SPRING SCRAPER CO. of Kalamazoo, Mich. and is advertized in the July 1998 issue of *Public Works* magazine. Both translating and dropping (or "chopping") interrupter plates appear to function well enough, but are subject to a great deal of side stress resulting from the acute projection of these devices into the flow stream.

In June 1998, U.S. Pat. No. 5,758,728 was issued, to me, for my invention that interrupts the windrow and, in which a plow blade includes two oppositely pivoted/hinged blade sections that emulate a trailing end of the blade by their alternating interpositioning. The sections are called "gates" and are connected so that one moves in the same general (fore-aft) direction as the other. Hingedly, but oppositely connected to the blade proper, one gate moves aft, bringing the second into coextensive alignment with the main blade portion. When the one blade swings forward, into a coextensive alignment with the main portion, the second moves into an acute angular relationship with that portion and blocks the debris flow. During the transition to operative (blocking) posture, debris/snow flow diminishes rapidly, but not with the acute termination of the older prior art that places undue side stress on the interrupter.

3. Incorporation by Reference

U.S. Pat. No. 5,758,728 is hereby incorporated by reference for its teaching of the use and motivation of an articulated blade and attachment to a pushing vehicle. It is also included to serve as a reference document for the various examples of prior art, as described above, including terms and definitions.

4. Definitions and Terminology

The following terms, not readily found in the incorporated reference(s), shall have the indicated meanings:

conterminous(ly) means sharing a common boundry (broadest sense);

driver is a mechanism that motivates (motivator) a device or an apparatus;

thrust bearing is a point, device or article which receives the force output from a driver/motivator; and to pilot is to guide.

BRIEF SUMMARY OF THE INVENTION

I have avoided the common deficit experienced in most of the prior art by devising an articulative blade adjunct which effects the desired windrow interruption without suffering the undue acute side stresses on the operative interrupter member. This invention can lead to cost savings by lengthening the life of such windrow-interrupting plowing equipment.

On the face of a conventional main plow blade, of the type often attached to a dump truck or pickup, but not limited thereto, there is placed a nearly center-hinged, double section, secondary blade that covers about one-quarter to about one-third of the main plow blade from its trailing edge. The shorter secondary blade is hingedly mounted to the main proximate the trailing edge. When the leading edge of the secondary blade, i.e., the edge closer to the main blade's leading edge, is motivated towards the common trailing edge, while guidedly constrained, by a conterminous track, along the main blade, the leading edge section (LES), by virtue of the center hinge which joins it to the trailing edge section (TES), will fold pleatwise against the TES. The resulting, pleated secondary blade cannot move beyond an acute angle with respect to the main blade because the travel of the shorter LES (of the secondary blade) is limited. I prefer to employ a shorter LES because placing a limitation on its travel allows variations in its length to control the angular relationship between the pleating elements (folding sections) and the main blade. Others, using my invention will find this feature most useful.

Movement (translation) of the LES is had by hydraulic actuator which is an ideal motivator for the rapid, forceful and positive action desired in this apparatus. Motivational driving force is applied to a pilot-thrust bearing assembly that is pivotally connected to the LES outer edge. Thrust may be applied centrally or proximate both leading corners of the LES, which is then guided along and by tracks (rails/grooves) situated behind/along the top and bottom margins of the main blade.

DETAILED DESCRIPTION OF THE INVENTION

Consistent with the art, the instant improvements employ a coventional superstructure or frame to join the plow mechanism to the pusher vehicle. In order to maintain clarity and brevity, I have omitted any vehicular apparatus and shown, in phantom, such a typical superstructure in FIGS. 1–3.

Figure 1:
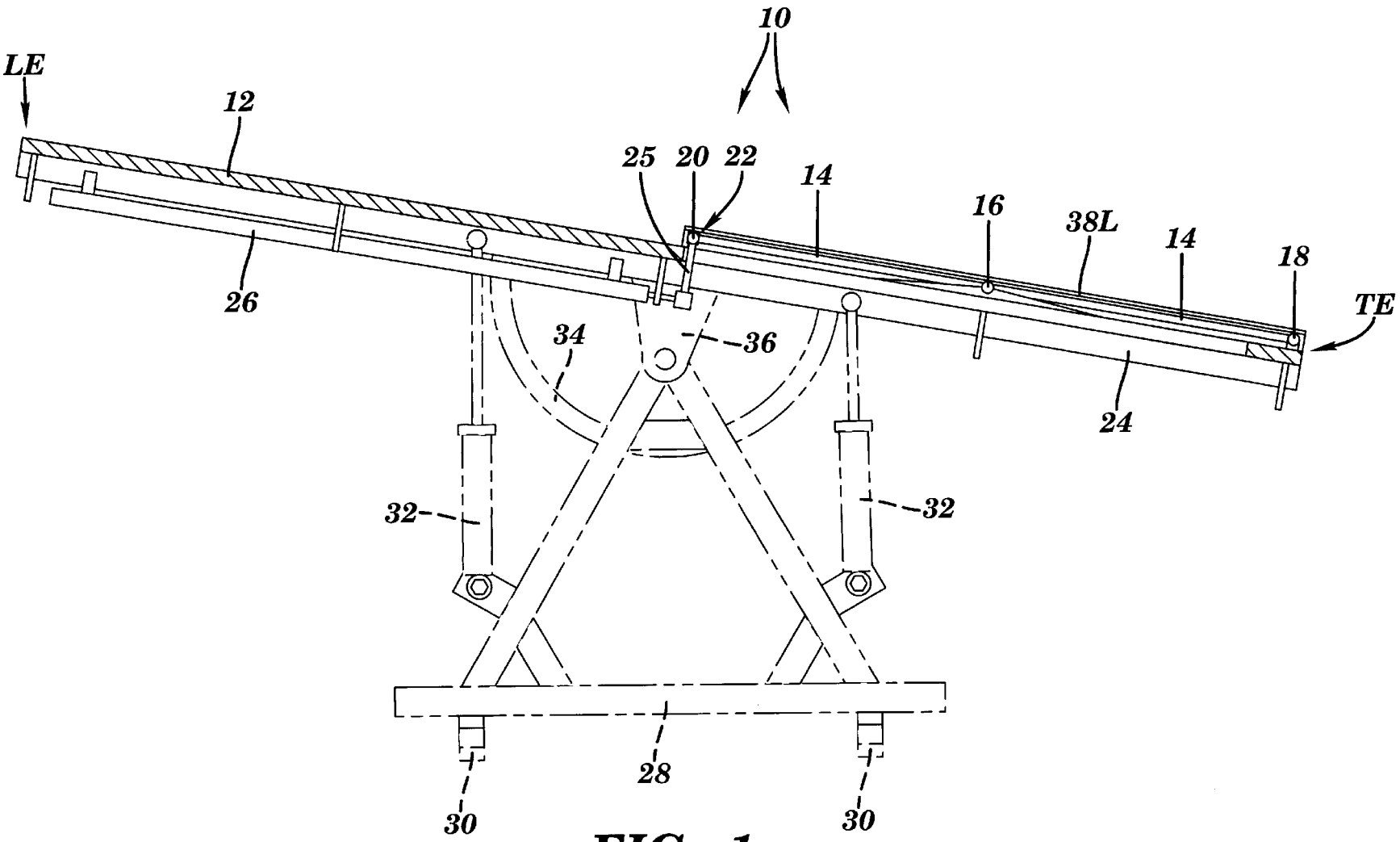
FIG. 1 is a plan view of the invention in non-interruptive mode.

Referring particularly to FIG. 1, there is shown, in a plan view, the invention 10, consisting principally of the blade 12 which is overlain by the auxiliary or adjunct blade 14. The auxiliary/adjunct, which folds or pleats vertically at hinge 16, is pivotally mounted 18 proximate the trailing edge/end TE of the main blade 12. At the end opposite its TE mounting, the auxiliary (hereinafter, "folding") blade 14 is held pivotally or hingedly captive by pilot bearings 20 which are movably, i.e., slidably captured in upper (not shown) and lower 38L guide tracks. [The guide track mechanism 38U, 38L is more clearly defined in FIG. 5.] A blade frame or bracket 24 is used to connect the main blade 12 to the superstructure that, as aforesaid, attaches the blade assembly to a vehicle; see incorporated reference, U.S. Pat. No. 5,758,728 ('728). The bracket 24 also serves as a mount for a hydraulic actuator 26. The actuator, via its output shaft, thrust bearing 22 and link 25, provides motivating force to translate the folding blade's 14 centermost edge (on bearings 20) away from the leading edge LE and towards the TE of the blade assembly. By its designed over-center disposition, hinge 16 will actuate the instant the centermost edge is forced from its "home" position; an action more clearly defined in FIG. 2–3. Continuing with a description of remaining apparatus shown in FIG. 1, I have shown the transitional mounting apparatus which may be used to attach the invention 10 to a vehicle (not shown). I use, as a base, a triangular bracket/framework 28 that connects to a vehicle by thrust mount fixtures 30 and, to the blade assembly, by apex connector/pivot 36. A D-ring 34 is connected at its base to a central part of the blade bracket 24, but the arcuate portion is allowed to slide through the tri-bracket 28 as the full blade assembly pivots on the apex connector 36. Thus, as the side actuators 32, disposed on the left and right between tri-bracket 28 and blade bracket 24, impart a yawing motion to the blade assembly, the D-ring constrains it from undesired pitching (up and down) motion, thereby avoiding damage to either blades or working surfaces. Control of the desired lifting and lowering of the blade assembly is accomplished by equipment and superstructure not considered germane to the invention and therefore not shown herein.

Figure 2:
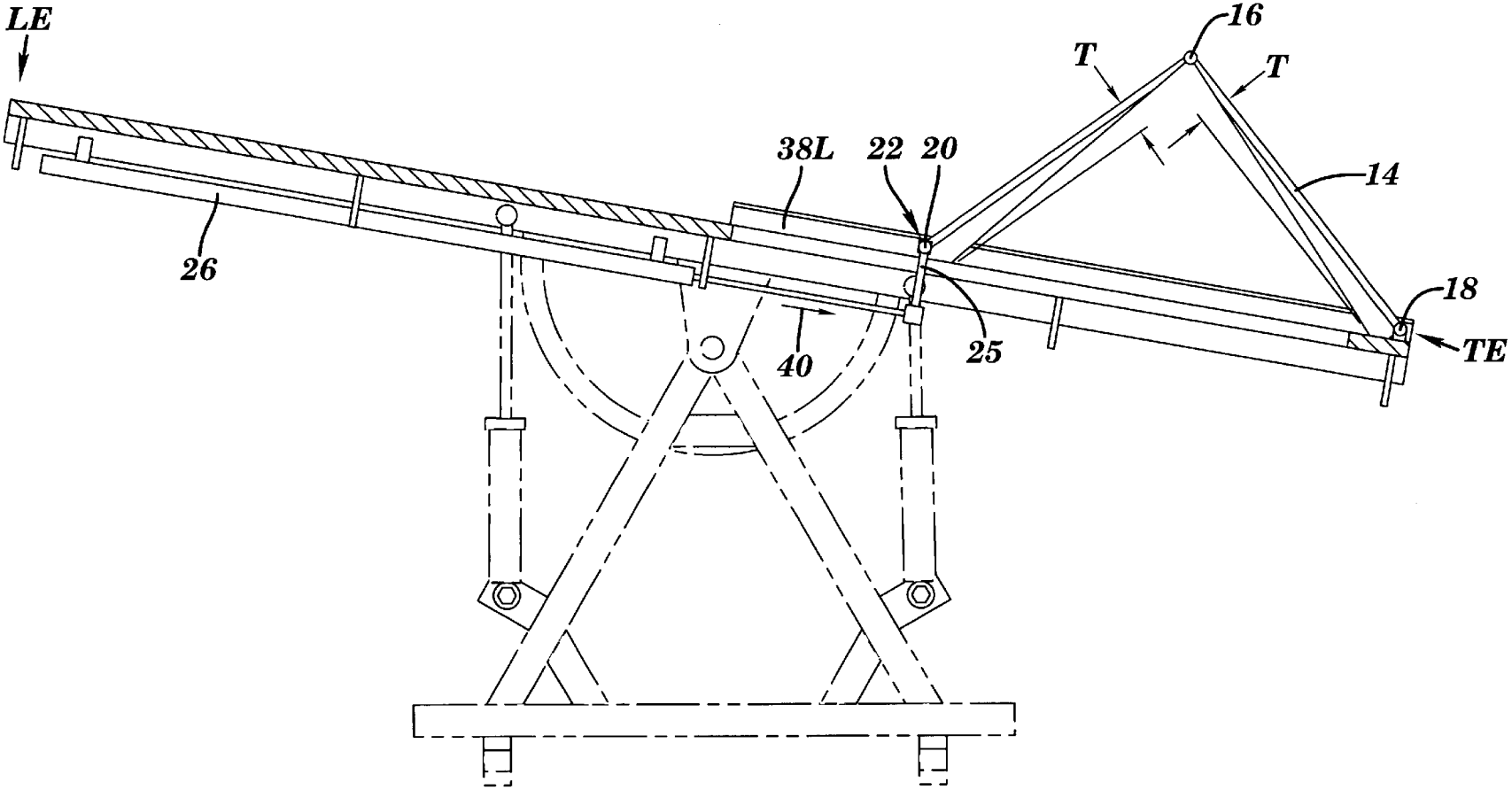
FIG. 2 is a plan view of the invention in transitional mode.
Figure 3:
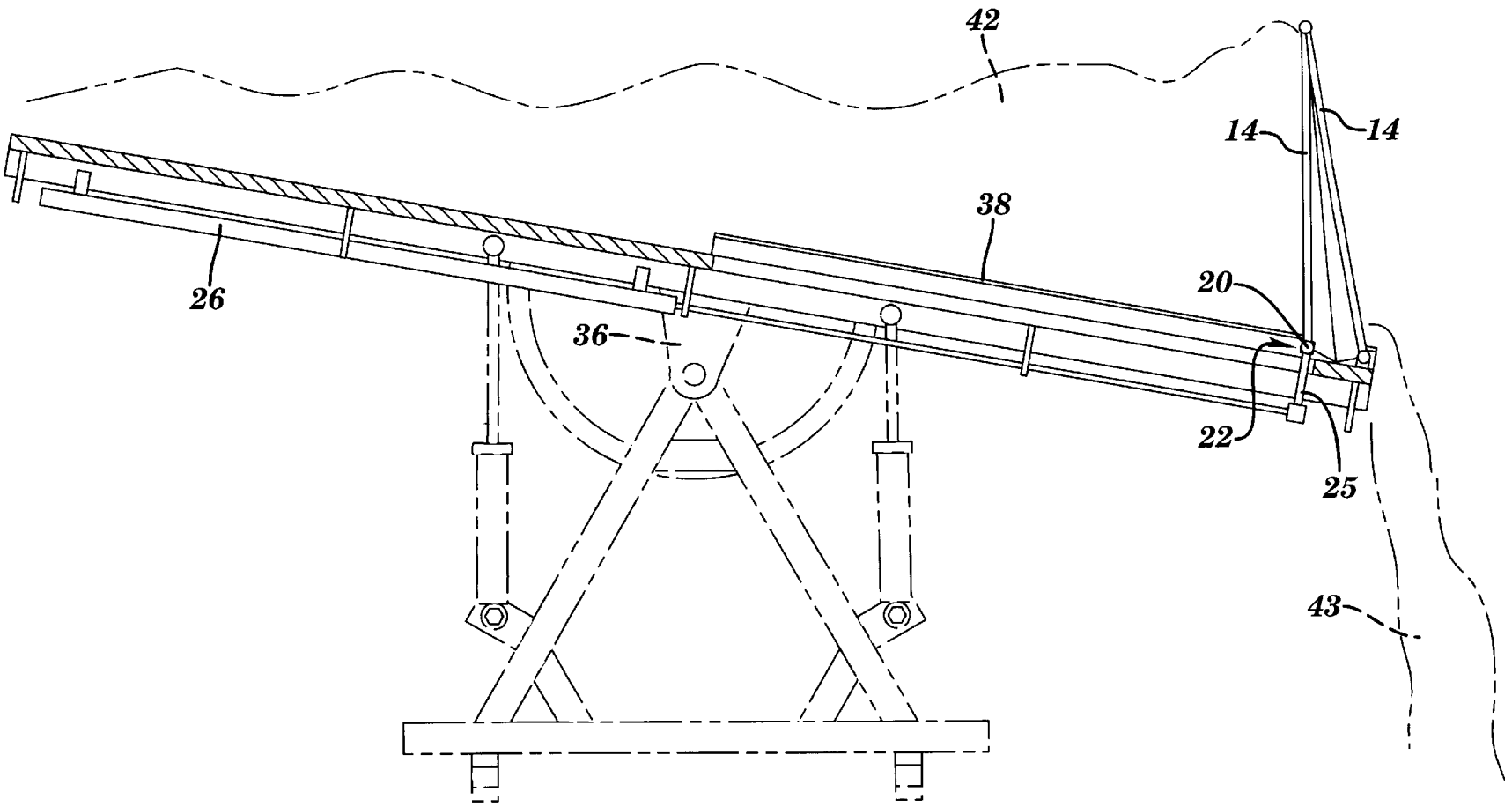
FIG. 3 is a plan view of the invention in fully operative, pleat-extended, interruptive mode.

FIG. 2 shows the FIG. 1 apparatus in operational transition as folding blade 14 is motivated by actuator force 40 in the direction shown. The link 25 remains rigid while the folding blade pivots on the hinging and thrust-bearing mechanisms (at 16,18 and 22). The translating end of the folding blade, held slidingly captive by pivot bearings 20, rides in the upper and lower tracks 38U,38L (only lower, 38L, shown). The embodiment shown here employs a folding blade having tapered T thickness towards hinge 16. This is done because the blades I have chosen to use have arcuate faces (seen more clearly in FIG. 5) which, if used to the extreme shown herein, could prevent the full pleating effect desired and shown at FIG. 3, where the folding blade 14 is illustrated in full pleated posture with both sections abutting, back-to-back. Reference being had to FIG. 3, the interrupting effect is demonstrated. All parts of my invention being designated as above, the newly shown items are the (increasing) overburden 42 and interrupted windrow 43.

Figure 4:
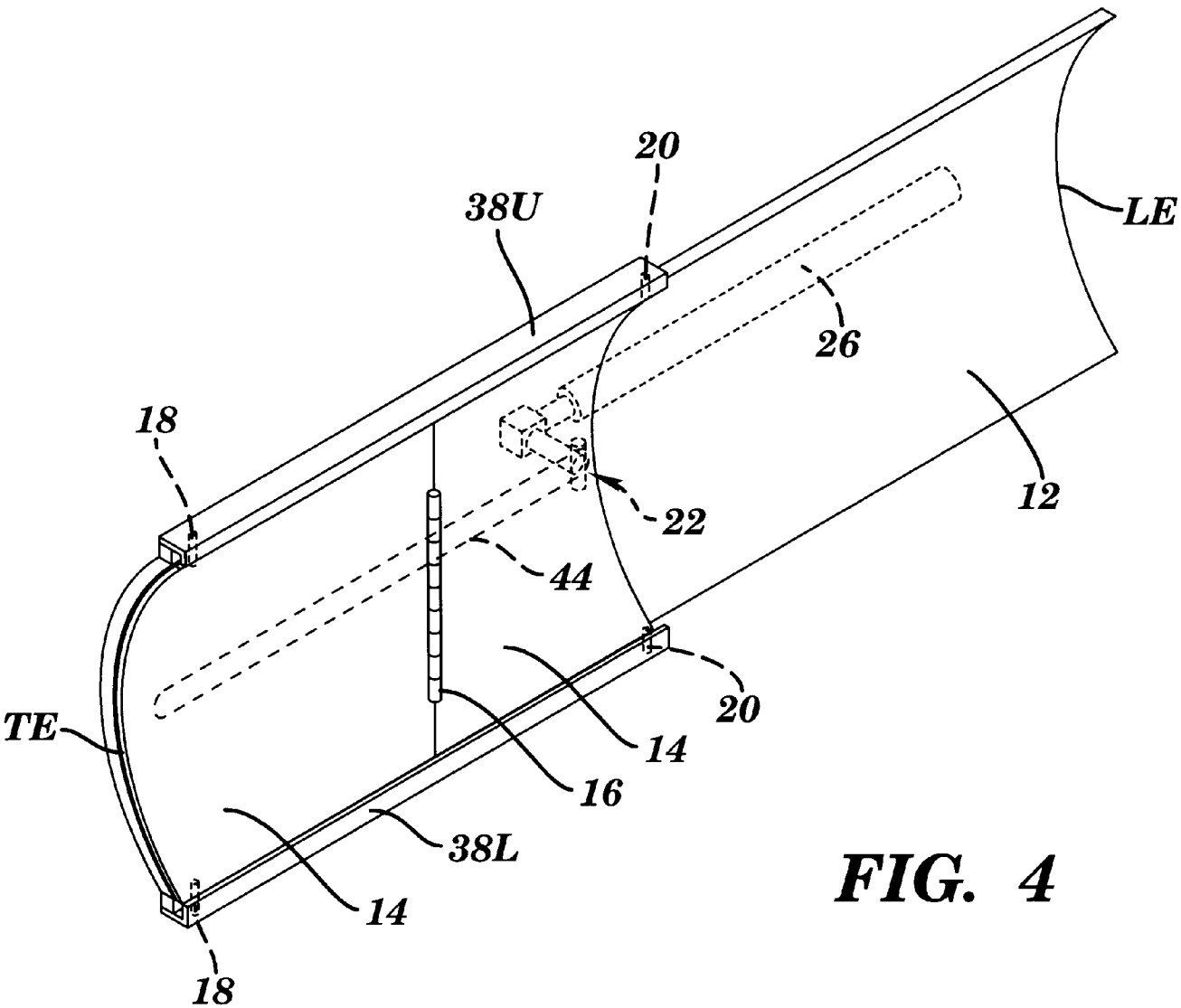
FIGS. 4 and 5 are frontal elevations of the invention with partial cut-away views.
Figure 5:
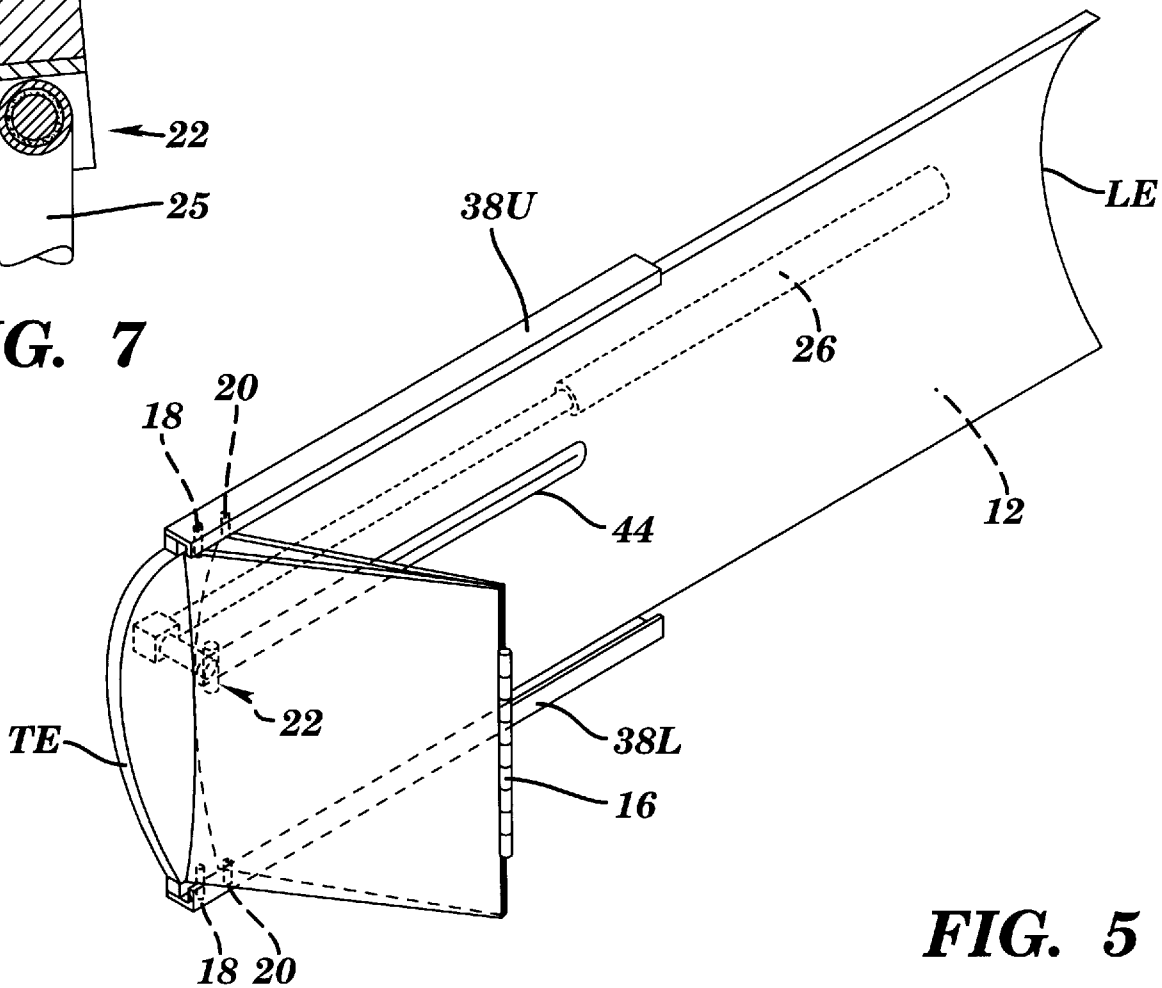

FIGS. 4 and 5 depict just the blades 12,14 and main actuator 26 (in phantom) in the FIGS. 1 and 3 postures, respectively. The facial curvature is somewhat exaggerated, but such is typically a designer's choice; and, on some blades, is placed only at the upper extreme, thus obviating the need for taper T, as seen in FIG. 3. Both upper and lower tracks 38U,38L are shown, as well as link slot 44, a through-groove which allows link 25 to connect with thrust bearing 22. Link 25 is thereby guided through its travel towards the TE of the assembly. FIG. 4, as in FIG. 1, also displays the auxiliary blade 14 in what I term "home" position or the "overlay" posture. I also point out that, if one were to use a flatter blade (or one curved only near the top), it is not only possible, but practical, to combine the thrust bearing 22-link 25 assembly with the pilot bearings 20 by hinging the link 25 to a vertical shaft, the end extensions of which would occupy the pilot bearing 20 positions. This modification is intuitive to those of ordinary skill and commands little more that these remarks.

Figure 7:
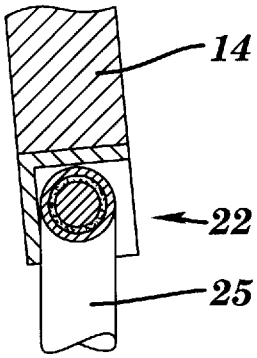
FIGS. 6 and 7 show, in cut-away plan view, a detail of the thrust-bearing hinge on the leading edge portion of the LES.
Figure 6:
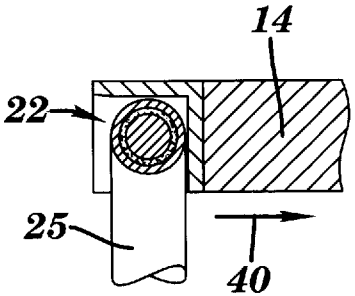

Final to this disclosure is the detail cross-section of FIGS. 6 and 7. The section is taken through the thrust-bearing 22 just above the link 25. When motivational force 40 is applied to the link, as shown in FIG. 6, the translation of folding blade 14 commences (as in FIG. 2) with an ensuing rotation of the pivotal end of the link 25 about the bearing 22. In reality, the blade 14 edge rotates with respect to the bearing, terminating in the posture shown in FIG. 7, as well as in FIGS. 3 and 5. Whether the bearing consists of a small hinge, as shown, or one having a more extensive length, terminating in two pilot bearings (as suggested above), is more a matter of designer's choice than manufacturing or operational necessity.

Many other minor design choices may be conceived and used to attain this invention's objective without departing from the basic concept disclosed or the spirit of the invention. The following claims compose the reasonable limits placed on such choices.

What is claimed is:

1. An adjunct to a plow main blade comprising:

a foldable interrupter blade movably disposed on a portion of a face of the main blade, said interrupter blade having a hinged end, a central folding means, a driven end and which is adapted for hinged movement at a trailing end of the main blade; and a motivating means for forcing translation of the driven end of the interrupter blade towards said hinged end to articulate the interrupter blade at said central folding means and cause it to project off the main blade in an angular relation thereto.

2. The adjunct of claim 1 wherein said central folding means is a hinge mechanism.

3. The adjunct of claim 2 wherein said motivating means is at least one actuator device connected by a linking means to the driven end of the interrupter blade.

4. The adjunct of claim 3 wherein said linking means comprises a thrust-bearing member adapted for guided movement along a face of the plow main blade.

5. An improvement to a plowing assembly that effects intermittent interruption of debris flow from a trailing edge of a plow blade comprising:

an auxiliary blade disposed part way over a face of the plow blade and featuring a translatable first end, a central hinge means and a second end that is pivotally connected to the trailing edge of the plow blade; and a motivation means for effecting an articulative, pleating action about the auxiliary blade central hinge means by forcing the first end to move towards the second end thereof.

6. The improvement of claim 5 wherein the motivation means is a hydraulic system linked to the first end of the auxiliary blade.

7. The improvement of claim 5 wherein the translatable first end is captured by a bearing-in-rail assembly for maintaining a set-apart, slidable registry of the first end over the face of the plow blade.

8. A mechanism for effecting interruption of a windrow flowing off a trailing end of a plow main blade and comprising a folding blade having a fixed pivotal edge, a translatable edge and adapted to fold pleatwise at a hinge means disposed between said pivotal edge and said translatable edge, said folding blade adapted for movable attachment to a face of said main blade, the folding blade further adapted to fold and effect a pleat that projects forwardly off the face and trailing end of the main blade and to unfold and overlay at least one-quarter of the face of the main blade.

9. The mechanism of claim 8 further comprising a constrainment means for guiding said translatable edge of the folding blade and maintaining it in a set-apart, slidable registry over the face of the main blade.

10. The mechanism of claim 9 wherein said constrainment means comprises a rail member for said guiding and said maintaining.

* * * * *